US008667906B2

(12) United States Patent
Änglavis

(10) Patent No.: US 8,667,906 B2
(45) Date of Patent: Mar. 11, 2014

(54) REMOVABLE DEVICE FOR FACILITATING EATING

(76) Inventor: Marija Änglavis, Norrköping (SE)

( * ) Notice: Subject to any disclaimer, the term of this patent is extended or adjusted under 35 U.S.C. 154(b) by 0 days.

(21) Appl. No.: 13/634,718

(22) PCT Filed: Mar. 15, 2011

(86) PCT No.: PCT/SE2011/050280

§ 371 (c)(1),
(2), (4) Date: Sep. 13, 2012

(87) PCT Pub. No.: WO2011/115556

PCT Pub. Date: Sep. 22, 2011

(65) Prior Publication Data

US 2013/0000527 A1 Jan. 3, 2013

(30) Foreign Application Priority Data

Mar. 18, 2010 (SE) ..... 1000249

(51) Int. Cl.
*A47B 57/00* (2006.01)

(52) U.S. Cl.
USPC ..... 108/97; 108/141; 108/8

(58) Field of Classification Search
USPC ..... 108/6–10, 97–98, 49, 157.1, 108/157.11–157.13, 139–141, 146, 147.18, 108/158.11, 158.13, 159.11, 152
See application file for complete search history.

(56) References Cited

U.S. PATENT DOCUMENTS 818,917 A 4/1906 Ruger
872,905 A * 12/1907 Connors ..... 108/8
956,095 A * 4/1910 Hoffman ..... 108/8
979,070 A * 12/1910 Hoffman ..... 248/447.2
1,247,112 A * 11/1917 Holmberg et al. ..... 108/139
1,249,165 A * 12/1917 Miller ..... 108/8
1,682,180 A 8/1928 Merrill
1,797,847 A * 3/1931 Vandagriff ..... 108/49
1,862,237 A * 6/1932 Pepler ..... 108/49
1,894,991 A * 1/1933 Hayes ..... 108/8
2,215,462 A * 9/1940 Davidson, Jr. et al. ..... 396/656

(Continued)

OTHER PUBLICATIONS

The International Bureau of WIPO, International Preliminary Report on Patentability and Written Opinion of the International Searching Authority for PCT/SE2011/050280; date of issuance of this report Sep. 18, 2012.

(Continued)

*Primary Examiner* — Hanh V Tran

(74) *Attorney, Agent, or Firm* — Andrew D. Gerschutz; Moore & Van Allen, PLLC

(57) ABSTRACT

A device to be attached to the edge of a table comprises a table clamp provided with a vertical hole in which one leg of an angled tube is fastened. The other leg of the tube is horizontal and has at its outer end a tray mount, which receives in a pivotable, fixable and removable manner a centrally situated vertical pivot pin on the underside of a tray on which food and beverages can be placed. By pivoting the tube in the table clamp and the tray in the tray mount the tray can be placed in the desired position and at the desired angle while allowing the table clamp to be positioned out of the way. By displacing and fastening the tube in the table clamp the tray can be vertically adjusted to permit a user to eat in comfort with the food within sight.

6 Claims, 2 Drawing Sheets

(56) References Cited

U.S. PATENT DOCUMENTS

| | | | | | |
|---|---|---|---|---|---|
| 2,533,893 | A | * | 12/1950 | Nussbaum | 108/5 |
| 2,558,323 | A | | 6/1951 | Strun | |
| 2,580,144 | A | * | 12/1951 | Webster | 108/64 |
| 2,609,938 | A | * | 9/1952 | Wells | 108/5 |
| 2,703,265 | A | * | 3/1955 | Wolfe | 248/214 |
| 2,710,051 | A | * | 6/1955 | Greenberg | 108/6 |
| 3,157,379 | A | * | 11/1964 | Platakis | 248/278.1 |
| 4,086,859 | A | * | 5/1978 | Dondero | 108/142 |
| 4,539,913 | A | * | 9/1985 | Marchant | 108/7 |
| 4,672,898 | A | * | 6/1987 | Davidson | 108/6 |
| 4,687,167 | A | * | 8/1987 | Skalka et al. | 248/126 |
| 4,852,499 | A | * | 8/1989 | Ozols | 108/44 |
| 5,281,001 | A | * | 1/1994 | Bergsten et al. | 297/411.24 |
| 6,209,835 | B1 | * | 4/2001 | Walrath et al. | 248/276.1 |
| 6,260,486 | B1 | * | 7/2001 | Boos et al. | 108/42 |
| 6,327,982 | B1 | * | 12/2001 | Jackson | 108/5 |
| 7,082,882 | B2 | * | 8/2006 | Heimbrock | 108/49 |
| 2007/0131149 | A1 | * | 6/2007 | Mayben | 108/97 |

OTHER PUBLICATIONS

•Nglavis, Marija, International Application No. PCT/SE2011/050280, International Search Report and Written Opinion, Jul. 13, 2011.

Anglavis, Marija, European Application No. 11756628.1, Extended European Search Report, Jun. 17, 2013.

* cited by examiner

REMOVABLE DEVICE FOR FACILITATING EATING

CROSS-REFERENCE TO RELATED APPLICATIONS

This application is filed under the provisions of 35 U.S.C. §371 and claims the benefit of International Patent Application No. PCT/SE2011/050280, filed on Mar. 15, 2011, entitled "REMOVABLE DEVICE FOR FACILITATING EATING", which claims the benefit of priority of Swedish Application No. 1000249-1, filed on Mar. 18, 2010, the contents of all of which are hereby incorporated by reference herein in their entirety.

Many people suffer from stiff necks and backs. The cause may be illness, age as well as accidents, for example whiplash injuries. One of the things that becomes more difficult if you suffer from a stiff back and neck, and in particular the latter, is eating. If you are unable to bend your neck you simply cannot see the food, and handling a knife and fork becomes virtually impossible. And this is an activity that you perform several times a day and perhaps also in different places.

The object of the invention is to reduce these problems so that eating in particular can be facilitated.

According to the invention, this problem is solved by a device to be used with a table, which device comprises an attachment means to be attached to the edge of the table, and an elevated platform or tray on which plates, glasses and cutlery are to be placed as well as means for adjusting and locking, respectively, the position of the tray relative to the table.

Figure 1:
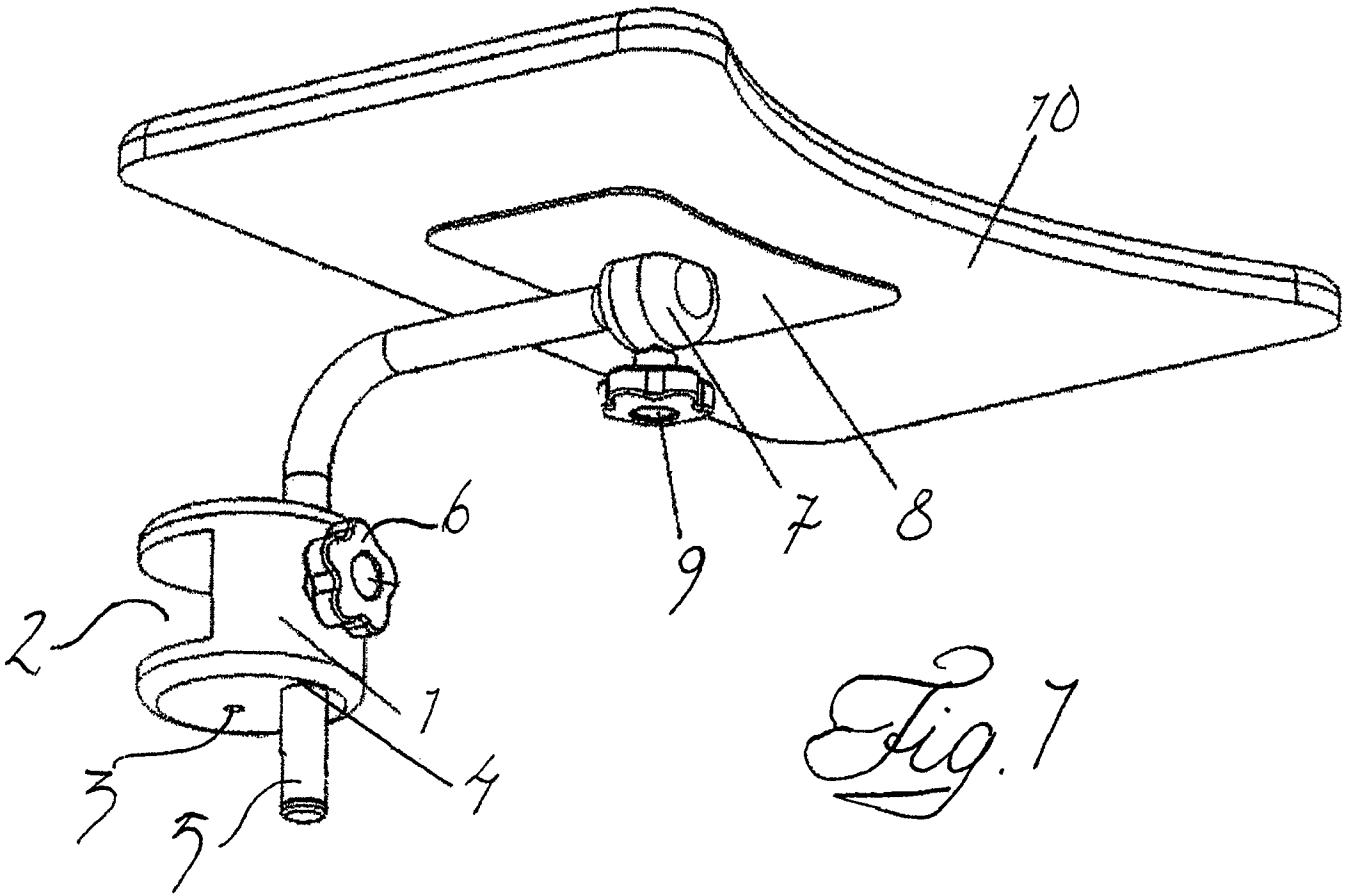
Figure 2:
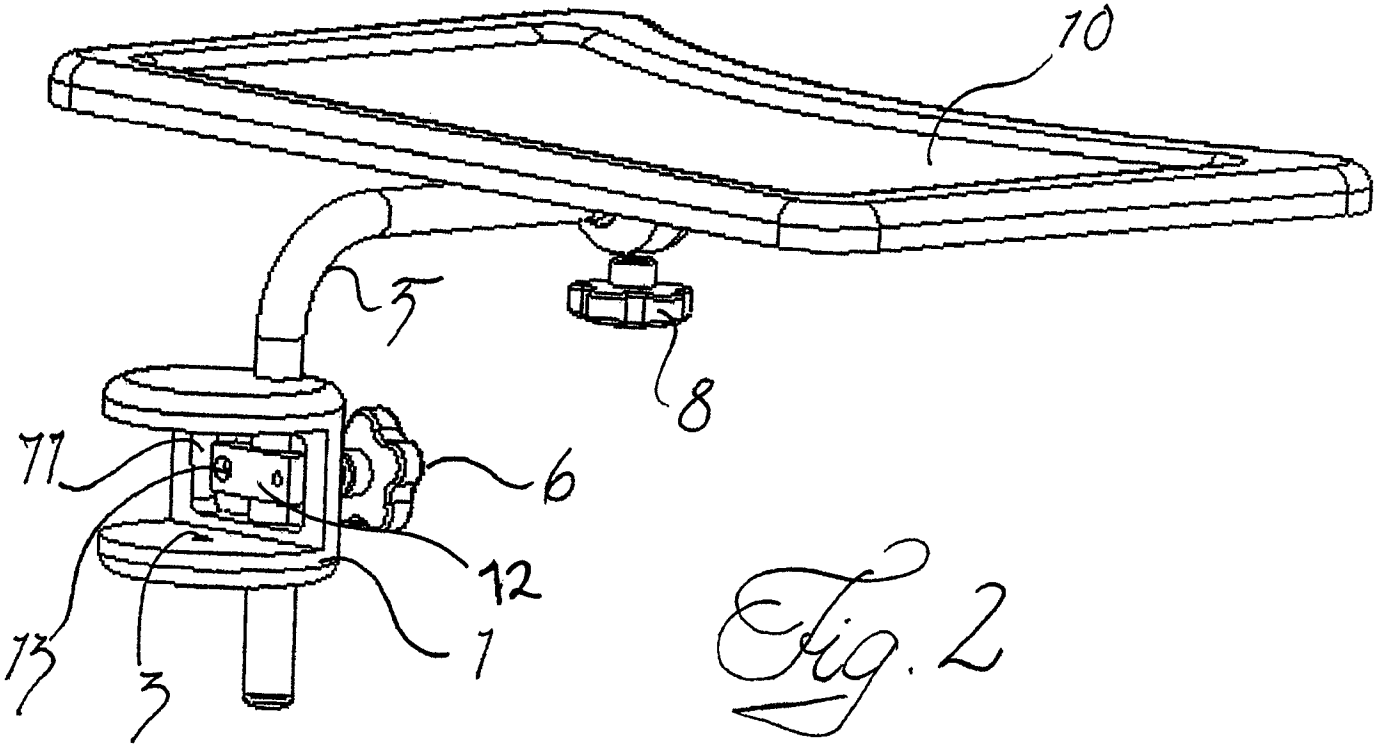

Further features and advantages of the invention will be apparent from the dependent claims and from the following description of a preferred embodiment, reference being made to the appended drawings. FIG. 1 shows a perspective view of the device as seen obliquely from below and in the direction of the table, and FIG. 2 shows the device as seen in perspective from the opposite direction.

The device illustrated in the drawing comprises a table clamp 1 having a horizontal recess 2 which is oriented towards the table and which is adapted to grip the edge of a table. On the underside of the recess is a threaded hole 3 through which a table knob (not shown) can be screwed by means of a threaded bolt, which directly or via a washer forming an integrated part of the bolt end can be pressed against the underside of the table to clamp the table edge in the recess 2.

The table clamp 1 further comprises a vertical through hole 4, in which a tube 5 is inserted. On the inside of the recess 2 there is provided a milled-out cavity 11 that extends a certain distance inside the outer periphery of the hole 4. In the milled-out cavity, an elongate washer 12 is arranged in the transverse direction relative to the hole 4 and the tube 5, respectively, which elongate washer is at one end movably attached to the table clamp by means of a screw 13, a bolt, which extends through the table clamp and on the other side thereof has a table knob 6, engaging with the other end. By tightening the knob 6 the washer is clamped against the tube so that said tube can be fixed in its axial position as well as in its angular position of pivot.

The tube 5 extends upwards from the table clamp and forms, after a tube bend, a horizontal portion, which in turn ends in a tray mount 7. The tray mount comprises a vertical, upwardly oriented cylindrical hole in which a pin of the corresponding dimension can be inserted from above. The pin is in turn attached to a supporting plate 8, which in turn is secured to the underside of a food tray 10. The tray is pivotable relative to the tray mount and can be fixed in the desired position by means of a tray knob 9, which by way of a threaded inner end can be screwed into a central threaded hole in the tray pin, such that the tray is pressed against the mount.

The angled tube 5 has a height that is sufficient to permit the required height adjustment and it is sufficiently long in the horizontal direction to be placed to the side of a user so that the table clamp will not be in the way of the user. The tray can be swung to a position above the table or can project in a greater or less degree from the edge of the table.

By loosening the three knobs the device can be divided into three easily manageable parts: a tray, a tube with a tray mount, and the table clamp.

When food is placed on the tray, the angled tube supporting the tray is affected, in the cylindrical hole, in the same way as a pulled-out drawer, i.e. when subjected to a load the retaining friction forces increase thereby reducing the risk of the tube sliding downwards. Already when adjusting the desired height of the tray this "drawer effect" helps to maintain the vertical position thereof until fastening is performed by means of the knob.

The fastening knobs described in the above examples have a relatively large diameter and can also, if required, be provided with a thread with a small pitch to make it easy to achieve sufficient securing forces. The knobs mentioned in the above examples can be replaced by bolts or screws provided with arms that are pivotable about an axis perpendicular to the longitudinal axis of the thread. It is also conceivable to use fastening means of the eccentric type for quick-acting locking.

The device according to the invention permits an elevated placing of a plate, a glass and cutlery, etc. relative to a table and is extremely stable, adjustable and reliable, so that individuals suffering from a stiff neck or back can eat in comfort. Moreover, no great forces are required during mounting and dismounting, which for many people may be very important.

The invention claimed is:

1. A device to be used with a table, comprising:

a table clamp to be attached to an edge of the table;

a platform or tray on which plates, glasses and cutlery are to be placed; and means for supporting the tray which are adjustable to permit adjustment and locking of the tray in an elevated position relative to the table, wherein the means for supporting the tray comprise:

a cylindrical hole in the table clamp, said cylindrical hole being vertically oriented during mounting relative to the table, a rod or tube displaceable in said cylindrical hole and extending upward from the table clamp to a fixed tube bend forming a horizontal portion constituting an arm, a clamping means configured to fix the rod or tube in the cylindrical hole and comprising an elongate washer having a first end pivotally attached to the table clamp and a second end movable in a swiveling manner relative to the table clamp, a self locking fastening means configured to reversibly lock the elongate washer to the rod or tube, wherein an intermediate section of the elongate washer is configured to press against the tube or rod when the self locking fastening means is tightened a tray mount supporting the tray on the arm, wherein the tray is pivotable relative to the tray mount, and a tray knob configured to fix the tray in a desired position on the arm.

2. A device according to claim 1, wherein the tube has a height sufficient to permit a required height adjustment and is sufficiently long in a horizontal direction to be placed to a side of a user.

3. A device according to claim 1, wherein the tray is pivotable, in use, about a vertical axis relative to the rod or tube and adapted to be fixed in its position of pivot.

4. A device according to claim 1, wherein the tray is removable.

5. The device according to claim 1, wherein the clamping means configured to fix the rod or tube in the cylindrical hole releases to vertically adjust a position of the tray along a continuum from the fixed tube bend to an opposing end of the rod or tube.

6. The device according to claim 1, wherein the self locking fastening means is a knob configured to move the intermediate section of the elongate washer towards the rod or tube when the knob is rotated.

* * * * *